US007388173B2

(12) United States Patent
Sundal et al.

(10) Patent No.: US 7,388,173 B2
(45) Date of Patent: Jun. 17, 2008

(54) HEATING CABLE

(75) Inventors: Arne Sundal, Drobak (NO); Jon Snesrud, Rasta (NO)

(73) Assignee: Nexans, Paris (FR)

( * ) Notice: Subject to any disclaimer, the term of this patent is extended or adjusted under 35 U.S.C. 154(b) by 28 days.

(21) Appl. No.: 11/295,172

(22) Filed: Dec. 6, 2005

(65) Prior Publication Data

US 2006/0151477 A1 Jul. 13, 2006

(30) Foreign Application Priority Data

Dec. 27, 2004 (NO) ..... 20045661

(51) Int. Cl.
*H05B 1/00* (2006.01)

(52) U.S. Cl. ..... 219/213; 219/528; 219/545

(58) Field of Classification Search ..... 219/213, 219/549, 528, 544, 545; 119/302; 165/49; 392/453; 104/279
See application file for complete search history.

(56) References Cited

U.S. PATENT DOCUMENTS

| | | | | | |
|---|---|---|---|---|---|
| 2,617,011 | A * | 11/1952 | Mackendrick | 219/528 |
| 3,454,747 | A * | 7/1969 | Hart | 219/549 |
| 4,436,988 | A * | 3/1984 | Blumenkranz | 219/544 |
| 4,878,332 | A * | 11/1989 | Drake | 52/745.05 |
| 5,516,985 | A * | 5/1996 | Merkel et al. | 174/74 A |
| 5,767,448 | A * | 6/1998 | Dong | 174/74 A |
| 5,792,987 | A * | 8/1998 | Dong et al. | 174/74 A |
| 6,097,009 | A * | 8/2000 | Cole | 219/528 |
| 6,274,812 | B1 * | 8/2001 | Daoud | 174/65 R |
| 6,294,768 | B1 * | 9/2001 | Liebich | 219/528 |
| 6,462,275 | B1 * | 10/2002 | Daoud | 174/65 R |
| 6,621,983 | B2 * | 9/2003 | Thorin | 392/435 |
| 7,045,716 | B2 * | 5/2006 | Granheim | 174/102 SC |
| 2005/0167134 | A1 * | 8/2005 | Charron | 174/36 |

FOREIGN PATENT DOCUMENTS

| | | | |
|---|---|---|---|
| DE | 1250026 | | 9/1964 |
| EP | 0858244 | | 11/1997 |
| EP | 930804 | A2 * | 7/1999 |
| EP | 1478211 | A2 * | 11/2004 |
| JP | 11037484 | | 2/1999 |
| JP | 11037484 | A * | 2/1999 |
| JP | 2000150121 | A * | 5/2000 |
| WO | WO 00/66951 | * | 10/2000 |
| WO | 2004033970 | | 11/2002 |
| WO | WO 2004033970 | A1 * | 4/2004 |

* cited by examiner

*Primary Examiner*—Tu Ba Hoang
*Assistant Examiner*—Vinod Patel
(74) *Attorney, Agent, or Firm*—Sofer & Haroun, LLP

(57) ABSTRACT

Heating cable comprising a first insulated conductor (1) and a second insulated conductor (2), which are located in a common sheath (4,5,6), wherein the first conductor (1) consists of electrical resistance material and the second conductor (2) consists of electrical resistance material or a material of high conductivity and wherein the first and second conductors (1,2) comprise first end regions (1*b*,2*b*) and second end regions (1*c*,2*c*) of a material of high conductivity and wherein end regions (1*c*,2*c*) of the first and second conductors (1,2) are electrically interconnected.

6 Claims, 3 Drawing Sheets

HEATING CABLE

RELATED APPLICATION

This application is related to and claims the benefit of priority from Norwegian Patent Application No. 2004 5661, filed on Dec. 27, 2004, the entirety of which is incorporated herein by reference.

FIELD OF THE INVENTION

The present invention relates to a heating cable in particular to a heating cable for use in floor heating systems.

BACKGROUND

DE-B-1 250 026 discloses a heating cable, in which pieces of electrical resistance conductors are soldered or welded to pieces of copper conductors so as to produce a continuous length of a heating cable conductor. The continuous length is provided with a continuous insulating layer and other protective layers and sheaths.

The continuous length is cut into predetermined sections of heating cables with "cold ends" that is that a piece of an electrical resistance conductor has two ends of copper conductors. The purpose of the cold ends is that when the heating cable is installed the terminations and interconnections of the heating cables are displaced from the heating areas. Another purpose is that quite often the heating cable route leading from the switch or termination on a wall to the heated floor will pass over or through building sections which should not be heated.

Single conductor heating cables have some essential drawbacks. Both ends of the heating cable must be connected to the house wiring system. This procedure is very time consuming.

Single conductor heating cables generate electromagnetic fields (EMF). The EMF discussion now and then pops up due to environmental/health considerations/awarenees.

EP-A-0 858 244 discloses a heating cable which reduces the generation of electromagnetic fields. The cable consists of a central resistance conductor, a concentric sheath of insulation material surrounding the resistance conductor and return conductor means arranged to be interconnected with the resistance conductor in the far end of the cables. The return conductor means consists of at least two separate conductors which are distributed in the cable core. The return conductors are preferably embedded in a common insulation sheath arranged over the resistance conductor sheath. The production of such a heating cable is very cost intensive.

OBJECT AND SUMMARY

The object of the present invention is to provide a heating cable, which generates acceptably small electromagnetic fields, which can be produced in an easy way and with low cost and which can be easily installed.

By means of the present invention there is obtained an improved heating cable, which results in a low-cost product. An essential advantage of the heating cable according to the invention is that due to the "cold end" of conductors the fault rate at the end seal of the cable is limited. Such faults can be induced by the shrinking of the insulation layer of the conductor as time goes by and the cable is switched on and off. Shrinking of the insulation layer will give direct contact between the electric heating cable and the earth potential. Shrinking of the insulation layer may create a pathway for water ingress into the cable and an electrical path between either the electrical heating cable and the earth potential or the earthed grid of the cable.

BRIEF DESCRIPTION OF THE DRAWINGS

The invention will now be described by way of an example in connections with the drawings in which FIG. 1 schematically shows a view of the heating cable.

DETAILED DESCRIPTION

Figure 1:
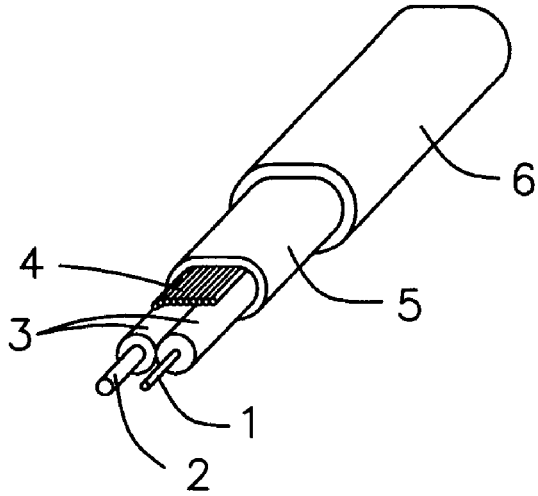

In a first embodiment of the invention the heating cable shown in FIG. 1 consists of a first conductor 1 of electrical resistance material such as constantan or similar Cu/Ni alloy and a second conductor 2 of high conductivity material such as copper. The first conductor 1 has end positions of high conductivity material such as copper.

In a second embodiment of the invention the conductor 2 may be of the same material as the first conductor 1 and is equal to this. Such conductors can be produced advantageously by a method described in DE-B-1 250 026. Each of the conductors 1 and 2 have a layer 3 of insulation material such as extruded and cross-linked polyethylene.

The two wholly or partly insulated conductors are surrounded by a layer 4 of metal wires, which layer 4 is surrounded by an extruded layer 5 of semi-conductive polymeric material such as polyethylene with an amount of carbon black. Both layers 4 and 5 serve as an earth wire and screen.

An extruded sheath 6 of a thermoplastic material such as polyvinylchloride or polyethylene surrounds the layer 5.

Figure 2:
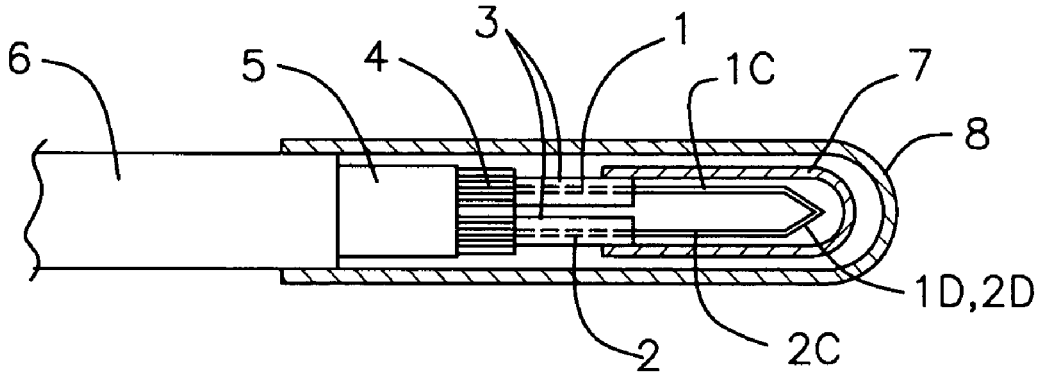
FIG. 2 schematically illustrates the end seal of the heating cable.

FIG. 2 shows the end of the heating cable opposite to the end which will be connected to an electrical power source. To prepare this end at first the sheath 6 and the layer 5 are removed from the end and the earth wires 4 are shortened. Then the insulation layer 3 is removed from the conductors 1 and 2. Each of the conductors 1 and 2 consists of a high resistance material and has end portions 1*c* and 2*c* of a high conductivity material. The end portions 1*c* and 2*c* are electrically connected at 1*d*, 2*d*.

The end portions 1*c* and 2*c* are interconnected by soldering or welding or by a crimp connection well known in the field of cable connections. Then a first cap 7 of insulation material is slipped on the interconnection region of the conductors 1 and 2. A second cap 8 is slipped on the end region of the heating cable and fixed to the sheath 6 of the heating cable. Both caps 7 and 8 may consist of a thermally shrinking material such as cross-linked polyethylene which shrink by the use of a flame as is well known in the cable technology.

In another embodiment of the invention the caps 7 and 8 consist of moulded caps of thermoplastic material, which may consist of two half-shells.

The caps 7 and 8 should be filled with an insulated material, in which the conductors 1 and 2 can be embedded. Such materials are silicone resin, petroleum jelly etc.

Figure 3:
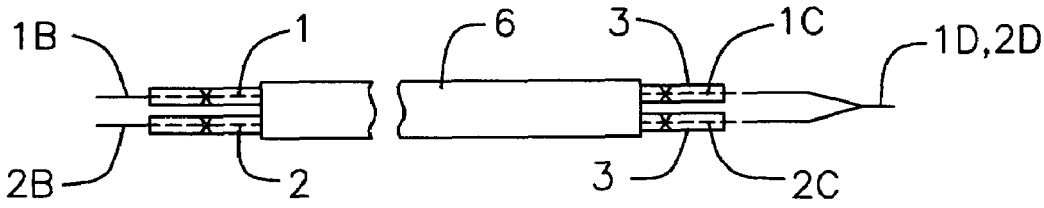
FIG. 3 and FIG. 4 show two optional solutions of cold-ends.
Figure 4:
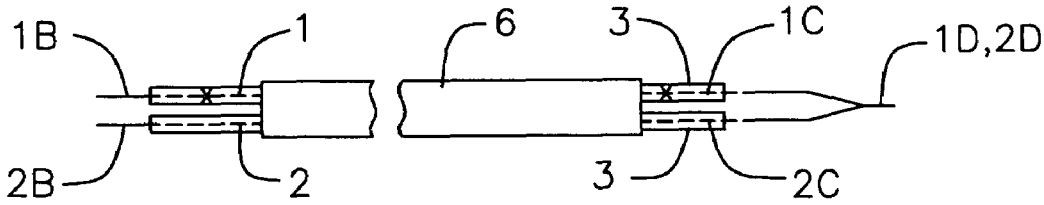

FIGS. 3 and 4 show two solutions to prepare a cold end at the end of a heating cable.

In FIG. 3 the first conductor 1 consists of an electrical resistance material with an end portion 1*b* of a material of high conductivity which is welded to the end of the conductor 1 as shown at x. The second conductor 2 consists of an electrical resistance material and has an end region 2*b* of a material of high conductivity, too. At the opposite end the conductor 1 has a portion 1*c* of high conductivity material which is electrically connected to conductor 1 at x. The conductor 2 has an end portion 2*c* of high conductivity material which is welded to the conductor 2 at x. The interconnection of the conductors 1 and 2 is made by welding soldering or by crimping as shown at 1*d* and 2*d*.

A further solution is shown in FIG. 4.

The conductor 1 is equal to the conductor in FIG. 3. The conductor 2 consists of high conductivity material. Both conductors 1 and 2 are electrically connected at 1*d*, 2*d*.

In order to prevent shrinking of the insulation layer 3 of the conductors 1 and 2 the end portions 1*b* and 2*b* should have a length between 1.5 and 10 m. For the same reason the length of the portions 1*c* and 2*c* should be between 0.15 and 0.50 m.

Figure 5:
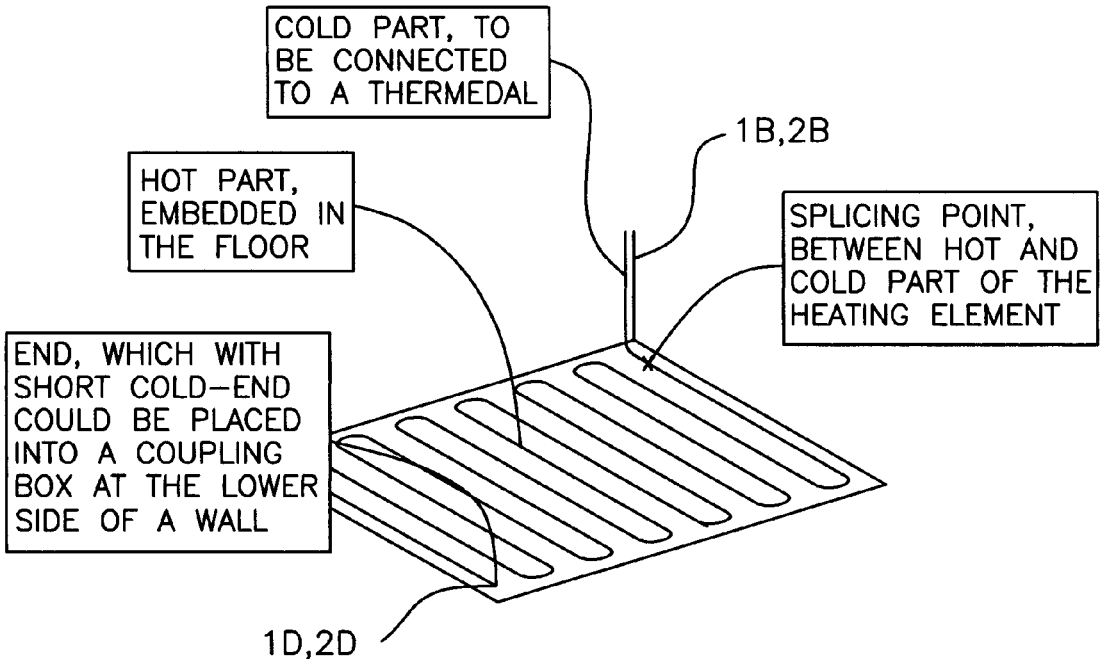
FIG. 5 and FIG. 6 show two optional solutions for a floor heating using a heating cable according to the invention.

FIG. 5 illustrates the heating cable of the present invention laid in a meandering way. The heating cable is laid out and is then embedded in concrete as is well known in the field of floor heating. The end regions 1*b* and 2*b* of the heating cable which consist of high conductivity material are connected to a not shown thermostat. The splicing point between the resistance part (hot part) and the high conductive part (cold part) is embedded in the concrete.

The length between the splicing point and the connection to the thermostat is preferably between 1.5 m and 10 m. The end seal, as described in FIG. 2 is embedded in concrete, too.

Figure 6:
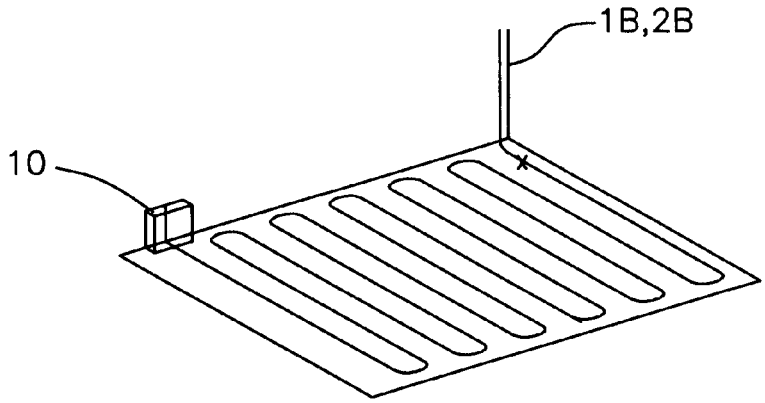

FIG. 6 shows an alternative solution for a floor heating using the heating cable according to the invention. In contrast to the solution of FIG. 5 the end seal is placed in a box 10 close to the heated floor. This makes the end seal easier available for inspection and/or repair.

The invention claimed is:

1. Heating cable comprising:

a first insulated conductor and a second insulated conductor, which are parallel to each other and located in a common sheath, wherein the first conductor includes electrical resistance material and the second conductor includes electrical resistance material or a conductor material and wherein the first and second conductors each has an end region including, a first end region and second end region respectively and wherein said first and second end regions of the first and second conductors are electrically interconnected, and wherein said interconnection of said first and second conductors is situated in a fully insulated cable joint, said interconnection being surrounded by at least two sealing caps or heat shrinkable tubes, with said first cap or tube being slipped on said interconnection and with said second cap or tube being slipped over said first cap or tube and fixed to said common sheath.

2. Heating cable according to claim 1, wherein the sealing cups are moulded thermoplastic cups.

3. Heating cable for heating floor according to claim 1, wherein the interconnection of the first and second conductors is situated in a box fixed to a wall of the room and the opposite end of the heating cable is connected to a power supply and the connection to the power supply is situated in a device which is fixed to the wall of the room.

4. Heating cable according to claim 3, wherein the splicing points between the conductors of high resistance material and the end regions of high conductivity material are located in the concrete.

5. Heating cable according to claim 3, wherein the length of the regions is between 1.5 and 10 m.

6. Heating cable according to claim 3, wherein the length of the end portions of high conductivity material is between 0.15 to 0.50 m.

* * * * *